United States Patent [19]

Holmes

[11] 4,026,510

[45] May 31, 1977

[54] WALL HANGER

[76] Inventor: Warren B. Holmes, 307 E. Florida Ave., Hemit, Calif. 92343

[22] Filed: May 17, 1976

[21] Appl. No.: 687,169

[52] U.S. Cl. ..... 248/493; 24/230.5 PH; 248/216.1

[51] Int. Cl.[2] ..... A47G 1/16; A47F 7/14

[58] Field of Search ..... 248/493, 497, 217, 498, 248/304, 301; 24/230.5 PH; D8/257

[56] References Cited

UNITED STATES PATENTS

| | | | |
|---|---|---|---|
| 406,255 | 7/1889 | Brinkerhoff | 248/493 |
| 3,911,516 | 10/1975 | Einhorn | 248/497 X |
| 3,912,211 | 10/1975 | Topf | 248/497 X |
| D189,241 | 11/1960 | Morrill | D8/257 |

FOREIGN PATENTS OR APPLICATIONS

| | | | |
|---|---|---|---|
| 696,752 | 10/1964 | Canada | 248/497 |
| 37,011 | 3/1933 | Netherlands | 248/217 |

*Primary Examiner*—J. Franklin Foss
*Attorney, Agent, or Firm*—Victor Sepulveda

[57] ABSTRACT

Herein described is a hanger for supporting articles on a vertical flat surface such as a wall which comprises a substantially flat base portion and an extending ledge therefrom. A radius is cut in the ledge and the wires or the like from the supported article are placed over the extending ledge. A lip conforming to the radius of the ledge extends upwardly to secure the wires or the like in place.

1 Claim, 2 Drawing Figures

WALL HANGER

BACKGROUND OF THE INVENTION

This invention relates to hanger members and more particularly to a wall hanger for hanging pictures or the like to a wall.

Heretofore wall hangers have comprised the necessity of using such things as relatively long nails, screws or what is referred to in the art as toggle bolts to secure pictures and the like to a wall. A problem is incurred in that most walls are made of plasterboard or other soft material so that a nail driven through a wall hanger is normally long and has to be secured into the wall at an angle so that the vertical pull thereon pulls the nail at this angle. On the otherhand, to secure the wall hangers tightly to the wall the toggle bolts or mollybolts are used which after the picture or the like is removed unsightly holes are left in the wall which then must be repaired.

The present invention is useful for supporting very large and heavy pictures, plaques or certificates securely to the wall with a minimum size hole in the wall and without the use of mollybolts or toggle bolts.

BRIEF DESCRIPTION OF THE DISCLOSURE

Briefly described the present invention comprises a hanger for supporting articles on a vertical flat surface or the like such as a wall which includes a substantially elongated base portion wherein one surface is flat and the base portion can be extremely thin which can be placed against the vertical wall. The base defines a pair of holes drilled therein so that the base portion can be secured to the wall with a relatively small nail. An outwardly extending ledge extends from the base portion and has a radius curvature extending across the base so that when the wire or the like from the picture-frame can be laid across the ledge. An outwardly extending lip which conforms to the radius of the ledge extends upwardly from the ledge and spaced from the base.

DESCRIPTION OF THE DRAWINGS

These and other features and advantages will become more apparent to those skilled in the art by taking into consideration with the following detailed description wherein like reference numerals indicate like or corresponding parts throughout the sample views, and wherein.

DESCRIPTION OF ONE PREFERRED EMBODIMENT

Figure 1:
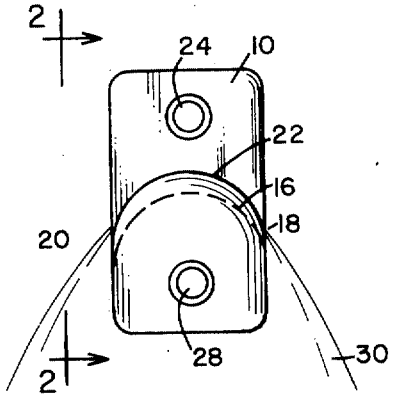
FIG. 1 is a frontal view of the hanger of the present invention.
Figure 2:
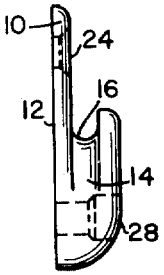
FIG. 2 is a side view taken along the lines 2—2 of FIG. 1.

Turning now to a more detailed description of one preferred embodiment of this invention there is shown from the substantially flat base 10 which as shown in FIGS. 1 and 2 made slightly elongated and has a relatively flat surface 12 thereon which is adapted to be placed flush up against a vertical surface such as a wall. Extending outwardly from the base 10 is a ledge 14 which has a curvature 16 therein which extends between the sides 18 and 20 of the flat base 10.

Spaced from the base 10 and extending upwardly from the ledge 14 is a lip 22 which corresponds in curvature and radius to the ledge 16.

A pair of holes 24 and 28 are drilled through the base 10 so that the base can be secured to a wall by suitable nails or screws. Basically the present invention only requires small nails.

The hanger with the curvature as shown at 16 supports a wire 30 from a picture frame (not shown) across the curvature 16 of the ledge 14. The vertical pull therefrom is downward from the nails in holes 24 and 28 rather than outward as in most present wall hangers. These will remain secure to the wall or vertical flat surface.

Having claimed but one preferred embodiment of this invention what is claimed is:

1. A hanger for supporting articles on a vertical flat surface, said hanger including:

a substantially elongated base portion having at least one flat side for placing against said vertical flat surface, said base including a first opening therethrough to accommodate a fastener to secure said base portion to said vertical flat surface;

an outwardly protruding smoothly contoured ledge extending from said base portion, said ledge having a radius of curvature extending across said base for holding a hanger member upon which are located said articles, a second opening formed within said ledge to accommodate a fastener to secure said hanger to said vertical flat surface, a line interconnecting the centers of said openings passing through said ledge and divides said ledge into two equal parts; and an upwardly extending lip attached to said ledge and spaced from said base to connect said hanger member to said ledge.

* * * * *